United States Patent [19]

McCarty

[11] 4,175,538

[45] Nov. 27, 1979

[54] ENERGY SAVING FURNACE CONSTRUCTION

[76] Inventor: Jimmie G. McCarty, 2805 Bethany Rd., Anderson, Ind. 46011

[21] Appl. No.: 871,637

[22] Filed: Jan. 23, 1978

[51] Int. Cl.[2] ..... F24C 3/00

[52] U.S. Cl. ..... 126/85 B; 98/48; 126/99 R; 126/109; 126/112; 126/364; 237/48; 237/53

[58] Field of Search ..... 126/85 B, 99 R, 99 A, 126/106, 108, 109, 112, 364, 132, 110 R; 237/48, 53, 55; 98/48; 165/DIG. 2

[56] References Cited

U.S. PATENT DOCUMENTS

| | | | |
|---|---|---|---|
| 148,567 | 3/1874 | Kendrick | 98/48 |
| 366,719 | 7/1887 | Frizelle | 237/48 |
| 1,267,490 | 5/1918 | Wurts | 237/48 |
| 1,295,407 | 2/1919 | Woods | 237/48 |
| 1,311,702 | 7/1919 | Mathis | 126/364 |
| 1,532,709 | 4/1925 | Morrill | 237/48 |
| 2,711,683 | 6/1955 | Ryder | 126/85 B |
| 3,105,432 | 10/1963 | Chamberlain | 98/48 |
| 3,521,582 | 7/1970 | Liden | 126/85 B |
| 3,662,735 | 5/1972 | Jackson | 126/85 B |
| 3,667,450 | 6/1972 | Skafte | 126/85 B |
| 3,845,754 | 11/1974 | Wilkening | 126/121 |
| 4,043,313 | 8/1977 | Sherman | 126/121 |

*Primary Examiner*—Samuel Scott
*Assistant Examiner*—Daniel J. O'Connor
*Attorney, Agent, or Firm*—Albert L. Jeffers

[57] ABSTRACT

A furnace shell has a fire pot centrally located therein, the walls of the shell and fire pot being spaced to form a fluid heat transfer chamber therebetween. Heat transfer is effected between the pot and the chamber to heat the fluid medium in the chamber. The shell is located in an interior to be heated, such as a building or home, including mobile and motor homes. An inlet conduit has a first end exteriorly positioned of the building interior and a second end substantially pneumatically sealed from the interior and in fluid communication with the fire pot enclosure to provide combustion supporting fluid exclusively from the exterior. A flue has a first end positioned exteriorly of said interior and a second end positioned in the upper portion of the fire pot enclosure to conduct combustion gases to the exterior. The flue is pneumatically sealed from the interior to prevent combustion gases from entering the interior. A heating medium, such as water or air, containment member is in heat transfer relationship to the chamber and is disposed to carry the heating medium into and from the interior for heating of the interior.

17 Claims, 4 Drawing Figures

ENERGY SAVING FURNACE CONSTRUCTION

BACKGROUND OF THE INVENTION

1. Field of the Invention

This invention is in the field of furnace constructions for primary heating of building or home interiors such as residential homes, commercial buildings, or mobile or motor homes.

2. Description of the Prior Art

Furnace constructions are used in almost every building, commercial and residential, and mobile and motor homes, in the Northern and Central United States. While economy of operation and fuel conservation have been objects in the design of such constructions over the years, these goals in recent years, especially the last decade, have been more important especially in view of the national energy crisis. Numerous devices have been proposed and produced in an effort to provide fuel conservation. While in general, these devices have succeeded in establishing a fuel savings, others have resulted in dangerous conditions which have restricted their uses and required stringent certification. Other devices, designed for residential fireplaces, and exemplified in U.S. Pat. Nos. 3,845,754 and 4,043,313 are designed to conserve fireplace fuel by sealing the fireplace combustion area from the room interior in which it is designed to heat, and furnishing the combustion air for the fireplace fuel from an opening exteriorly from the building in which the fireplace is constructed. However, these efforts have been restricted to fireplaces and have not been utilized in combination with construction which would make them adaptable for primary home heating furnace construction, including, importantly, primary furnaces for mobile and motor homes.

SUMMARY OF THE INVENTION

This invention is directed to a primary furnace construction for residential and commercial buildings and mobile or motor homes wherein a heating chamber is provided between the furnace fire pot and a furnace shell or housing, situate in a building, with the chamber being used to heat a fluid medium through heat transfer from the fire pot to the chamber to a fluid medium containment member. Conduit and flue members are provided to supply combustion supporting air from a point exteriorly of the building to the fire pot combustion enclosure and exhaust combustion gases from the fire pot to the building exterior, with the path of the air from outside the building to the fire pot enclosure being through the conduit, and the path of combustion gases from the fire pot enclosure to a point exterior of the building being through the flue and both paths being pneumatically sealed from the building interior. Further, the only entrance for combustion supporting air is through the conduit so that heated interior air is not utilized for supporting fuel combustion thereby economizing on loss of heated air from the building interior.

This invention is adaptable to existing conventional furnace constructions by building around the conventional furnace a shell which receives in pneumatically sealed relation an inlet conduit. The inlet conduit provides combustion supporting air from outside the building or home to the shell interior. The shell has an opening on the upper surface thereof for receiving the conventional flue in pneumatically sealed relation. Further, the shell, which may be insulated as with asbestos or the like, is spaced from the furnace walls to define a heat transfer chamber. A heat containment member, such as a pipe carrying water, air, or other heating medium, is received by the shell in substantially pneumatically sealed relation, and is placed in heat transfer relation to the chamber, and exits the shell in a pneumatically sealed manner to provide a heating medium for the building or home interior. Also, the building or home hot water system pipes may be received by the shell in substantially pneumatically sealed relation for heat transfer thereto.

It is therefore an object of this invention to provide a heating system for a building or home that provides the fuel combustion supporting air exclusively from outside the building or home to conserve energy lost from using heated interior air for fuel support combustion.

Another object of this invention is to provide a construction of the previous object which is adaptable to existing conventional furnaces for conservation of energy.

A still further object of this invention is to provide a construction of the previous objects which may be utilized in motor or mobile homes.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
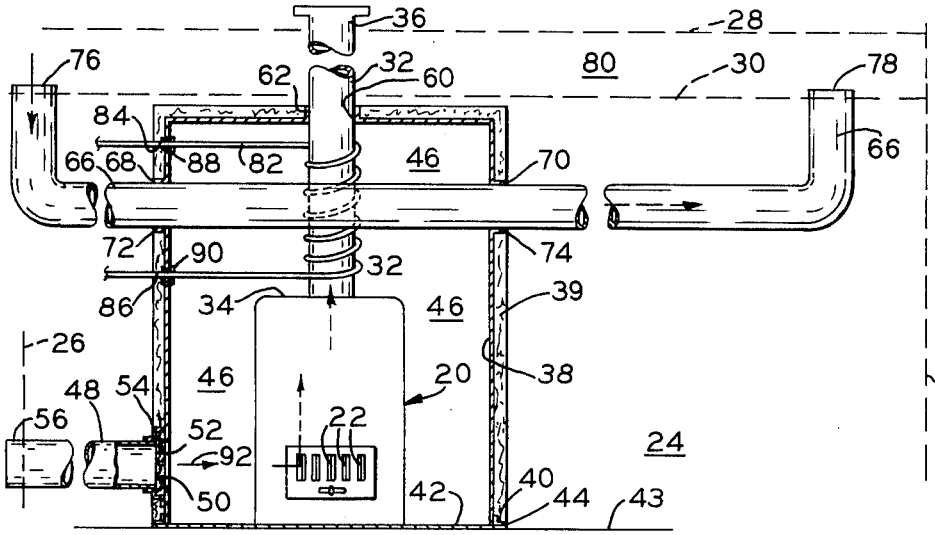
FIG. 1 is a partially broken away and diagrammatic side elevational view of a preferred embodiment of this invention, with the outer shell shown in section, for adapting this invention to a conventional furnace.

Referring to the drawing, FIG. 1, a conventional furnace 20 having combustion air vents 22 positioned at the lower portion thereof, is provided with a fuel inlet and burner, not shown, but which may be conventional gas, oil, or coal units. Furnace 20 is positioned in a building or home interior 24 defined by walls 26 and roof 28 shown by dashed lines but which may be of conventional construction. Typically, furnace 20 is located at a lower level, such as a basement, in a building and a second level, having a floor 30, shown in dashed lines and also which may be of conventional construction, is typically the living or working area of the building. Additional levels may be provided as is well known in the art.

Furnace 20 has a flue 32 in fluid communication with the upper surface 34 thereof, with flue 32 extending through level 30 and roof 28 to the building exterior and terminating in chimney 36 of conventional construction which is open to the outside air. A shell 38, which may be of a structurally rigid, heat and fireproof material, such as metal, encloses furnace 20 and is secured, as by brackets 40 to a floor plate 42 supported on floor 43 of the first level on which furnace 20 is supported. A seal ring 44 is provided around the base of shell 38, which completely surrounds furnace 20, thus pneumatically sealing shell 38 to floor plate 42 preventing any air passage. Shell 38 is provided with a layer of thermal insulation 39 around the exterior wall thereof, which insulation is heat and fireproof and may be of a material such as asbestos, or other comparable available material.

The walls of shell 38 are spaced from the walls of furnace 20 to define heat transfer chamber 46 therebetween. An inlet conduit 48 has end 50 in fluid communication with and in registration with opening 52 in shell 38, with a seal ring 54 of conventional construction for pneumatically sealing end 50 with opening 52. End 56 of conduit 48 is positioned exteriorly of wall 26 and is open to outside air so that a fluid tight conduit is provided from the outside air to the interior of shell 38. In this manner, combustion supporting air for furnace 20 is provided from exteriorly of the building or home, through conduit 48, into chamber 46, through vents 22. Flue 32 passes through opening 60 in shell 38 and extends through corresponding openings in floor 30 and roof 28 to chimney 36. A pneumatic seal ring 62 is provided between opening 60 and flue 32 and is of a heat resistant fireproof material such as is well known in the furnace art.

A heat medium containment member 66, the heat medium in this embodiment being air and the member being an air duct, extends through shell 38 and into chamber 46. Member 66 is supported in openings 68 and 70 formed in the walls of shell 38 and pneumatic seal rings 72 and 74 are placed respectively between member 66 and openings 68 and 70. Member 66 in a typical installation extends through floor 30 at ends 76, 78 to heat the second level interior 80. Also, a second heat medium containment member 82, wherein the heat medium is water and the member is a copper tube, is fluidly coupled to the building or home hot water heating system to supply auxiliary heat to a hot water heating tank with suitable valves, thermostats, and pumps, not shown, to properly heat and utilize the water. Tube 82 passes through openings 84, 86 in shell 38 and pneumatic seal rings 88, 90 are placed respectively between pipe 82 and openings 84 and 86 to prevent fluid passage through openings 84 and 86. Pipe 82 is coiled about flue 32 to provide for efficient heat transfer therebetween.

In operation of the embodiment of FIG. 1, air from the exterior of the building or home enters end 56 of conduit 48 as indicated diagrammatically by arrow 92, passing through vents 22 in furnace 20 into the furnace fire pot to supply combustion supporting fluid to the fuel therein. The furnace 20 exterior becomes heated and heat transfer occurs by connection, conduction and radiation to the medium, typically air, in chamber 46. The combustion gases, which are at a high temperature, pass through and heat flue 32 which also provides a heat transfer to chamber 46 and to tube 82. The heating medium, typically water, in tube 82 is brought relatively quickly to a high temperature and, with suitable valves, thermostats, and pumps, not shown, can be stored in an insulated storage tank for use by the building or home occupants.

Further, heat transfer from chamber 46 occurs to pipe 66 and the heated medium, typically air, therein is, by means of a gravity flow system, fan, or other air circulating means, not shown, is circulated to interior 80 through end 78 of pipe 66, with the cold return air entering end 76 of pipe 66. It is to be understood that the portion of pipe 66 within chamber 46 can be wound about furnace 20 in coil fashion or otherwise more fully occupy chamber 46 to increase heat transfer efficiency. As mentioned, the embodiment of FIG. 1 is a conversion unit for existing conventional furnaces having air intake vents 22 positioned therein.

Figure 2:
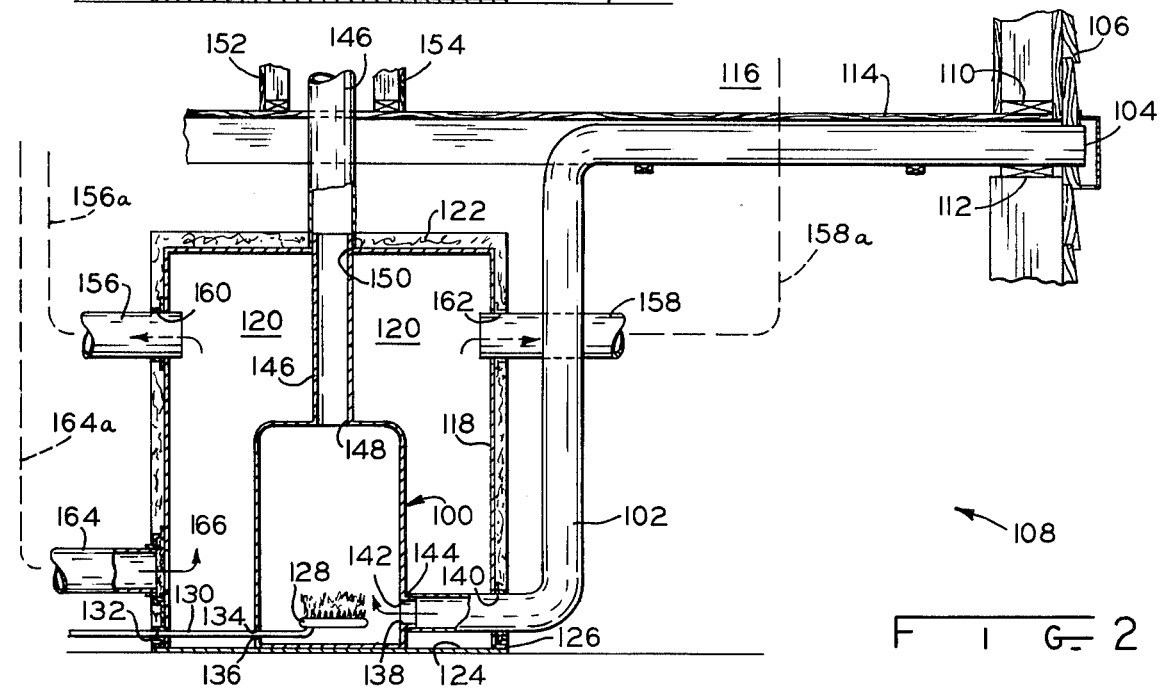
FIG. 2 is a partially broken away and diagrammatic side elevational view, shown partly in section, of a second preferred embodiment of this invention showing the inlet conduit more completely.

Referring now to FIG. 2 of the drawing, an embodiment is shown wherein a furnace fire pot 100 is constructed according to the teaching of this invention. In this embodiment, the construction is simpler and the number of pneumatic seals is substantially reduced. An inlet conduit 102 has a first end 104 extending exteriorly of an outside wall 106 of a building or home 108, with end 104 being supported between sills 110, 112 in wall 106 and is supported below floor 114 which defines the lower surface of heated area 116. A screen may be placed over opening 104 to prevent the entry of wild life.

A shell 118, made of a rigid heat resistant fireproof material such as heavy gauge sheet metal, is constructed about furnace 100 and the walls thereof are spaced from the walls of furnace 100 to form a heat exchange chamber 120 therebetween. Shell 118 preferably has a heavy layer of thermal insulation 122 affixed to the outer walls thereof to inhibit heat transfer from chamber 120. Shell 118 is affixed to the furnace floor plate 124 by means of a perimetral pneumatic seal ring 126 placed in sealing relation between the lower perimeter of shell 118 and floor 124.

Fire pot 100 has burner 128 supported therein in a lower area thereof and is supplied with a fuel such as gas or oil through line 130. Line 130 extends through opening 132 in shell 118 and opening 134 in the wall of pot 100 with a pneumatic seal ring 136 placed between line 130 and the wall of pot 100 to prevent fluid passage or leakage.

The second end 138 of conduit 102 extends through the wall of shell 118 at opening 140 and is in fluid communication with pot 100 at opening 142 in the pot wall. A pneumatic seal ring 144 is placed about end 138 to prevent fluid passage or leakage between the interior of pot 100 and chamber 120. Again, rings 136 and 144 are of conventional construction known to the art. A flue 146 is sealingly adjoined to opening 148 in pot 100 and extends through opening 150 in shell 118. Flue 146 extends through floor 114, and is suitably thermally insulated therefrom as is conventionally practiced in the art, and extends between walls 152 and 154 to the building or home chimney, not shown, also as is conventional in the building arts. Thus, the interior of pot 100 is pneumatically sealed from chamber 120 and therefore it is unnecessary that chamber 118 be pneumatically sealed from the building interior.

A pair of heat medium containment members 156, 158, which may be conventional hot air ducts where the medium is air, are received by openings 160 and 162 in shell 118. Members 156 and 158, as shown by dotted lines 156*a* and 158*a*, are directed to the building or home interior to provide heating thereof through the conventional hot air registers.

A cold air return duct 164 for conveying return cold air from the building interior is received by enclosure 118 at opening 166. If desired, for increased efficiency, pneumatic seal rings may be placed at openings 132, 140, 150, 160, 162, and 166.

In the operation of the embodiment of FIG. 2, fuel supporting combustion air is supplied from exteriorly of the building or home at opening 104 of conduit 102 through opening 138 into the combustion area of pot 100. Since the pot 100 interior is pneumatically sealed from chamber 120, and thus also from the remainder of the building or home interior, no heated interior air is used for combustion. The operation of burner 128 causes the temperature in furnace 100 to rise and heat exchange from furnace 100 to chamber 120 causes the temperature of the air in chamber 120 to rise. This air is then forced by fan, not shown but conventional in the art, into duct members 156 and 158 to the building interior heating registers. The cold air from the building interior is collected in duct 164 for return to chamber 120 where it is heated and recirculated into the building interior through ducts 156 and 158. As mentioned, this invention is also useable in gravity feed systems and in systems using other heating mediums such as water.

Figure 3:
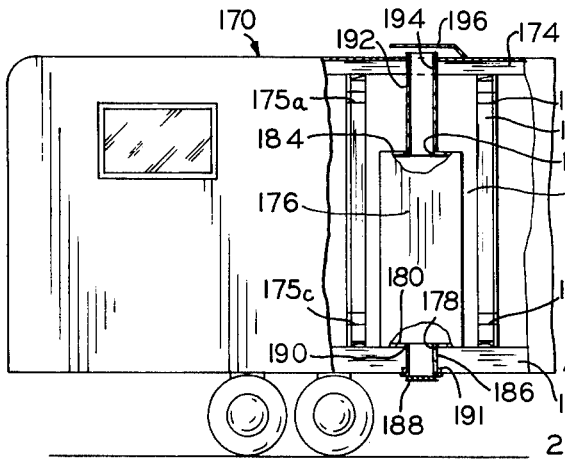
FIG. 3 is a side elevational view, shown partly broken away and in section, of a third embodiment of this invention used in a mobile home.

Referring now to FIG. 3 of the drawing, an embodiment of this invention is shown which is of particular advantage and application in the motor and mobile home field. A mobile home 170 having floor 172 and roof 174, has positioned therein a cylindrical housing 175 in which is placed a furnace 176, having the conventional burner units and fuel supply, not shown. Housing 175 has opening **175*a* and 175*b* placed at the upper end thereof and openings 175*c* and 175*d* at the lower end thereof. A chamber 177 is formed between housing 175 and furnace 176. The walls and surfaces of furnace 176 are pneumatically impervious with the exception of an opening 178 in the bottom surface 180 thereof and an opening 182 in the top surface 184 thereof. Inlet conduit 186 extends directly downwardly from opening 178 through floor 172 and opens to the underside of home 170. A screen 188 is placed over the lower opening of conduit 186 to prevent animal entry into conduit 186. A pneumatic seal ring 190 is placed between conduit 186 and opening 178 to prevent fluid transfer between furnace 176 and the home interior. Also, a pneumatic seal ring 191 is placed between conduit 186 and floor 172 to prevent fluid transfer between the home interior and outside air. A flue 192 is sealingly adjoined to opening 182 of furnace 176 to prevent any combustion gases from entering chamber 177 and the home interior. Flue 192 extends through opening 194 in roof 174 and a weather guard 196 is attached to roof 174 and extends over the opening of flue 192 to prevent precipitation into the open end of flue 192. A pneumatic seal is placed between flue 192 and roof 174** to prevent fluid transfer between the home interior and outside air.

In the operation of the embodiment of FIG. 3, fuel combustion supporting fluid is admitted directly through screen 188 and the open end of conduit 186 into the fuel combustion area of furnace 176 which is pneumatically sealed from the interior of home 170. The combustion gases then exit through flue 192 through the roof 174 in conventional manner. In a smaller heated area, such as a mobile home, frequently no other heat exchange is required than that between furnace 176, chamber 177, openings **175*a*, 175*b*, 175*c*, and 175*d***, and the home interior so that an extremely simple, efficient heating system of low cost in manufacture and installation is provided. It is to be understood that if additional heat duct members for conveying heat to the extremities of the home are desired, they can be incorporated in the manner of the previously described embodiment. Also, this invention is adaptable to recreational vehicles and other vehicular units having a heating requirement.

Figure 4:
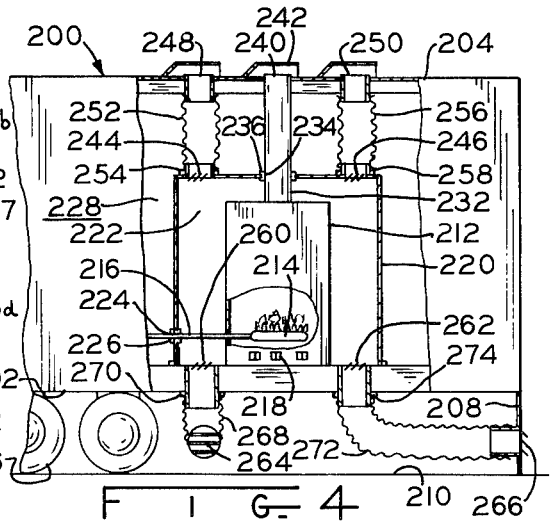
FIG. 4 is a partial, sectioned view of a mobile home embodiment of this invention.

Referring to FIG. 4, a mobile home 200 having a floor 202 and a roof 204, is supported above the ground by wheels 206 and a suspension system, not shown. A skirt 208 extends from floor 202 to ground 210, as is customary in many mobile homes which are situated for semi-permanent location, to enhance the appearance of the home. A furnace 212 is supported in the home 200 on floor 202 and has a burner 214 positioned therein fed by a gas line 216. Vents 218 are formed in the outer wall of furnace 212 slightly below burner 214 to supply combustion air thereto.

A shell 220 is constructed about furnace 212 and spaced therefrom to form a heat exchange chamber 222 therebetween. Shell 220 is made of an impermeable fireproof material such as heavy gauge sheet metal. Opening 224 is formed in shell 220 and gas line 216 extends therethrough to a gas supply, not shown. A pneumatic seal ring 226 is placed between opening 224 and line 216 to prevent fluid flow between chamber 222 and the interior 228 of home 200. A flue 232 is pneumatically adjoined to furnace 212 and extends through an opening 234 in shell 220 and a pneumatic seal ring 236 is placed between opening 234 and flue 232. Flue 232 extends through an opening 240 in roof 204. A weather guard 242 is attached to roof 204 and extends over the opening of flue 232 to prevent precipitation into the open end of flue 232.

Vents 244, 246 are formed in the upper surface of shell 220 and openings 248 and 250 are formed in roof 204 and also may be protected by weather guards, as shown. Impermeable duct 252 is pneumatically sealed by ring 254 to the upper surface of shell 220 and extends to and is attached to roof 204 about opening 248. Impermeable duct 256 is attached by pneumatic seal ring 258 to the upper surface of shell 220 and extends to and is attached to roof 204 about opening 250. In this manner, not only is outside air provided for supporting combustion of the fuel in burner 214, but any gas leaks in line 216 will be vented through vents 244, 246 to the outside atmosphere when the gas used, such as natural gas, is lighter than air.

Vents 260, 262 are formed in floor 202 and vents 264, 266 are formed in skirt 208. Impermeable duct 268 is pneumatically adjoined by seal ring 270 about vent 260 on floor 202 and is attached to skirt 208 about opening 264. Impermeable duct 272 is pneumatically adjoined by seal ring 274 to floor 202 about vent 262 and is also attached to skirt 208 about vent 266. Thus, not only is exterior air furnished through openings 264, 266, vents 260, 262, into chamber 222 and through vents 218 to support combustion of the fuel in burner 214, but any leaks in line 216 of a gas heavier than air, such as propane, will be vented to the atmosphere exteriorly of home 200 and will not be collected beneath floor 202 and thus become an explosion hazard. Therefore, Applicant's invention provides a dual purpose of providing not only exterior air for combustion purposes, thus providing energy conservation, but also is a safety feature in minimizing an explosion hazard.

Pneumatic sealing and seal rings are defined herein as substantially fluid tight seals, with the degree of fluid sealing corresponding to the efficiency of the furnace construction. The higher the degree of fluid sealing, the higher the efficiency. It is to be understood, of course, that seals between the flues and the fire pot must be absolute to prevent combustion gases from entering the building or home interior.

This invention provides a high degree of occupant safety from asphyxiation, especially as compared to chimney dampers which have been utilized in order to conserve the loss of heated interior air entering the furnace grate vents but have not been widely accepted due to the potential danger of occupant asphyxiation due to damper malfunction.

This invention is equally adaptable to steam or hot water systems with the heat exchange portions of those systems being located in chambers 46 and 120.

While there have been described above the principles of this invention in connection with specific apparatus, it is to be clearly understood that this description is made only by way of example and not as a limitation to the scope of the invention.

What is claimed is:

1. A fuel burning furnace construction for heating an enclosed interior defined by and separated from the exterior by a floor, a roof, and a wall construction between the floor and roof, comprising:

a fireproof shell positioned in the interior;

a furnace having a fuel burning enclosure situate in said shell; said shell and said furnace being spaced from one another to define a fluid chamber therebetween;

means for pneumatically sealing said fuel burning enclosure from said interior;

an inlet conduit having a first end opening exteriorly of said interior and a second end opening into fluid communication with said enclosure;

means for pneumatically sealing said inlet conduit from said interior and for providing combustion supporting fluid for the fuel exclusively from without said interior:

a flue having a first end opening exteriorly of said interior and a second end opening into said enclosure; said flue being pneumatically sealed from said interior to thus prevent combustion gasses from said interior;

heating medium means for providing heat transfer relative said chamber and disposed to transfer heat to a medium in the interior for heat transfer to and heating of the interior.

2. The apparatus of claim 1 including means for pneumatically sealing said chamber from said interior;

said heating medium means being positioned in and pneumatically sealed from said chamber.

3. The apparatus of claim 1 wherein said interior is defined by a mobile home, said furnace being positioned in said home and supported on the floor of said home; said floor having an opening configured to receive said inlet conduit first end opening.

4. The apparatus of claim 3 wherein said roof has an opening in fluid communication with said enclosure.

5. The apparatus of claim 1 wherein an animal guard member is fitted in said first end opening to inhibit entry of animals in said inlet conduit.

6. The apparatus of claim 1 wherein said shell is insulated to retain heat transferred by said furnace.

7. The apparatus of claim 1 wherein said furnace has opening means for sealingly receiving said inlet conduit second end.

8. The apparatus of claim 1 wherein said furnace has opening means for sealingly supporting said flue second end.

9. The apparatus of claim 8 wherein said heating medium means comprises an inlet to said chamber from said interior and an outlet from said chamber to said interior.

10. The apparatus of claim 9 wherein said inlet is placed below said outlet.

11. The apparatus of claim 1 wherein said heating medium means comprises a closed path continuous tubular member carrying said heat medium; said tubular member being disposed for a portion of its length in said chamber.

12. The apparatus of claim 11 wherein said portion encircles said flue.

13. The apparatus of claim 1 including a water heating system; a second heating medium means fluidly coupled to said system and being in heat transfer relation to said furnace.

14. The apparatus of claim 13 wherein said second heating medium means is a tube coiled about said flue in near adjacency to the furnace wall.

15. The apparatus of claim 1 wherein said chamber is substantially pneumatically sealed from said interior; said furnace having vents to provide combustion supporting air to said furnace; said inlet conduit being in fluid communication with said chamber.

16. The apparatus of claim 1 including a venting duct between said chamber and the roof of said interior to vent fuel gas to the exterior.

17. The apparatus of claim 1 including a venting duct between said chamber and a lower surface of said interior to vent fuel gas to the exterior.

* * * * *